US008888242B2

(12) United States Patent
Fang et al.

(10) Patent No.: US 8,888,242 B2
(45) Date of Patent: Nov. 18, 2014

(54) FLUID EJECTION DEVICES AND METHODS FOR FABRICATING FLUID EJECTION DEVICES

(75) Inventors: Jiandong Fang, Lexington, KY (US); Xiaoming Wu, Lexington, KY (US)

(73) Assignee: Funai Electric Co., Ltd. (JP)

( * ) Notice: Subject to any disclaimer, the term of this patent is extended or adjusted under 35 U.S.C. 154(b) by 448 days.

(21) Appl. No.: 13/112,278

(22) Filed: May 20, 2011

(65) Prior Publication Data

US 2012/0293584 A1 Nov. 22, 2012

(51) Int. Cl.
*B41J 2/135* (2006.01)

(52) U.S. Cl.
USPC ..... 347/44

(58) Field of Classification Search
CPC ..... B41J 2/1628
See application file for complete search history.

(56) References Cited

U.S. PATENT DOCUMENTS

2010/0201744 A1* 8/2010 Saito et al. ..... 347/40
2010/0201754 A1* 8/2010 Tsuchii et al. ..... 347/65

* cited by examiner

*Primary Examiner* — Stephen Meier
*Assistant Examiner* — Renee I Wilson
(74) *Attorney, Agent, or Firm* — Amster, Rothstein, Ebenstein LLP

(57) ABSTRACT

Disclosed is a fluid ejection device for an inkjet printer that includes a substrate having at least one fluid flow channel configured within a bottom portion of the substrate. Each fluid flow channel of the at least one fluid flow channel is configured by etching the bottom portion. The substrate also includes a plurality of fluid flow vias configured within a top portion of the substrate. Each fluid flow via of the plurality of fluid flow vias is configured by etching the top portion. The each fluid flow via is further configured to be in fluid communication with a corresponding fluid flow channel through an isotropically etched cavity configured below the each fluid flow via and fluidically coupled to the corresponding fluid flow channel. The fluid ejection device also includes a flow feature layer and a nozzle plate. Further disclosed are methods for fabricating fluid ejection devices.

8 Claims, 15 Drawing Sheets

FLUID EJECTION DEVICES AND METHODS FOR FABRICATING FLUID EJECTION DEVICES

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to printers, and more particularly, to fluid ejection devices for printers.

2. Description of the Related Art

A typical fluid ejection device (heater chip) for a printer, such as an inkjet printer, includes a substrate (e.g. silicon substrate) carrying at least one fluid ejection element thereupon; a flow feature layer configured over the substrate; and a nozzle plate configured over the flow feature layer. The flow feature layer includes flow features (fluid chambers and fluid channels), and the nozzle plate includes a plurality of nozzles.

Various fluid ejection devices employ polyimide-based nozzle plates with laser ablated nozzles. In such fluid ejection devices, a fluid (such as ink) of a particular color is fed from a fluid tank to fluid ejection elements through long and large fluid through vias configured in respective substrates of the fluid ejection devices. Further, in such fluid ejection devices, comb-shaped flow feature arrays are laid out along edges of the fluid through vias, such that flow features (separating walls) of the flow feature arrays are configured perpendicularly to the fluid through vias.

As opposed to the individual assembly of the polyimide-based nozzle plates at the die level, photoimaged nozzle plate (PINP) based process proceeds in the wafer level to lithographically form fine nozzles on a laminated nozzle plate dry film. Employing PINP based process for fabricating fluid ejection devices results in benefits, such as short turnaround time, low development cost, and demonstrated consistent processing. However, the use of the PINP based process requires nozzle plates to have good photo-imageability, robust chemical properties, good thermal properties, and strong mechanical properties, which are at least comparable to that of previous polyimide-based nozzle plates.

Typically, a fluid ejection device employing a photoimaged nozzle plate, may have five fluid through vias for fluids of colors such as Cyan, Magenta, Yellow, blacK, and blacK (CMYKK). Such fluid through vias may have a dimension of about 0.2 millimeter (mm)×0.5-1 inches (") (i.e., width× length. However, suspending a nozzle plate over such large and long fluid through vias may prove to be problematic for the processing of the nozzle plate. For example, low glass temperature (Tg) of PINP film, as used for forming the nozzle plate, may allow a narrow processing window for thermal processes, such as lamination with very tight control, post exposure bake, and final bake, needed to prevent variable large nozzle plate sagging over the fluid through vias, thereby resulting in negative effects on performance and lifetime of the fluid ejection device. Specifically, suspending the nozzle plate over the large and long fluid through vias may lead to ejected fluid droplet misdirection due to large nozzle plate sag; lamination failure while configuring the nozzle plate (particularly, above flow features and flow feature filtering pillars) because of nozzle plate elasticity change during the processing of the nozzle plate and the servicing of the fluid ejection device; fluid ingressive attack on the large exposed nozzle plate surface that may accelerate nozzle plate deformation and delamination; and so forth.

In addition, current trend of inkjet technology for achieving higher printing resolutions requires higher spatial density of nozzles with narrow flow features between firing chambers and thin nozzle plate. However, narrower flow features further weaken adhesion between the flow feature layer and either the nozzle plate or the substrate due to reduced contact area. Further, thin nozzle plate over large fluid through vias requires the nozzle plate to possess high mechanical strength and a better fluid (chemical) resistance.

Also, in a typical fluid ejection device packaging process, residual stress remains on the fluid ejection device due to mismatch of Coefficient of Thermal Expansion (CTE) between system components such as the fluid ejection devices, assembly substrate (ceramic, liquid crystal polymer or other plastics), and thermally cured adhesive, etc. For a fluid ejection device with multiple large (long) fluid through vias, each silicon section between adjacent fluid through vias responds to the residue stress differently due to non-uniform mechanical strength. Accordingly, it is difficult to maintain planarity across the fluid ejection device. Further, an uneven surface of the fluid ejection device definitely stretches the suspending nozzle plate and changes nozzle plate's surface (topography), thereby, resulting in an unpredictable factor for fluid ejection misdirection. Although the photoimaged nozzle plate is fully cured, the photoimaged nozzle plate becomes less fluid-resistant due to additional strain from the aforementioned stretching. Severe bulging of the photoimaged nozzle plate may then quickly develop above the fluid through vias leading to ejection misdirection and eventual failure of the fluid ejection device.

Till date, various attempts have been made to fabricate fluid ejection devices with shorter fluid through vias with an aim of circumventing the aforementioned problems. FIGS. 1-4 illustrate an exemplary process flow for configuring shorter fluid through vias within a substrate of a fluid ejection device. Specifically, FIGS. 1-4 depict side cross-sectional partial views of a substrate 100 (silicon substrate). As depicted in FIG. 1, the substrate 100 includes a top portion 102 and a bottom portion 104. The substrate 100 may be then etched to configure a plurality of fluid through vias 110 (short vias) within the top portion 102 of the substrate 100, as depicted in FIGS. 2 and 4. Further, the substrate 100 may be etched to configure at least one fluid flow channel, such as a fluid flow channel 120, in the bottom portion 104 of the substrate 100, as depicted in FIGS. 3 and 4. It may be evident that the fluid through vias 110 and the fluid flow channel 120 may be configured either simultaneously or in any order. Further, the fluid through vias 110 and the fluid flow channel 120 may be configured within the substrate 100 by a deep reactive ion etching (DRIE) process.

FIG. 4 depicts the substrate 100 that may be used for configuring a flow feature layer and a nozzle plate thereon for forming a fluid ejection device, such as a fluid ejection device 10, as depicted in FIG. 5. Specifically, FIG. 5 depicts a top perspective view of the fluid ejection device 10 that includes the substrate 100 with the fluid through vias 110; a flow feature layer (not shown); and a photoimaged nozzle plate 130 (hereinafter referred to as 'PINP 130'). The PINP 130 includes a plurality of nozzles 132. The nozzles 132 may be for one or more fluid colors. In the aforementioned configuration, each firing chamber (not shown) of the fluid ejection device 10 is fed by one fluid through via of the fluid through vias 110. Thus, the spatial density of the fluid through vias 110 is the same as that of the nozzles 132. Further, the fluid through vias 110 are arranged in two rows 112, 114, as depicted in FIG. 5. Furthermore, the flow feature layer of the fluid ejection device 10 includes a plurality of flow feature channels 142 and a plurality of filtering pillars 144. Although the fluid flow channel 120 of the substrate 100 is not shown in FIG. 5, the fluid flow channel 120 is a long slot hidden underneath the rows 112, 114 of the fluid through vias 110.

Depth of a fluid through via, such as the fluid through vias 110, determines flow resistance to firing chambers, and should be uniformly small (such as about 15 microns to about 60 microns) across the fluid ejection devices, such as the fluid ejection device 10. As mentioned above, the aforementioned conventional approach (process flow of FIGS. 1-4) for such a fluid ejection device 10 employs two DRIE processes from both sides (the top portion 102 and the bottom portion 104) of the substrate 100 to define the fluid through vias 110 and the fluid flow channel 120. However, a DRIE process may only be timed to reach a depth window due to fluctuating/varying etching rate. The width of the DRIE depth window is generally associated with normal etching rate and normal etching depth. Specifically, the width of the DRIE depth window may be about 50 micrometers (μm) for an etching rate of about 25 μm/minute in a silicon wafer having a thickness of about 400-600 μm. However, an appropriate depth of a fluid through via needs to be around 30 μm, as predicted by micro fluidics to provide appropriate flow resistance. Accordingly, conventional process flows (such as the process flow of FIGS. 1-4) may be an ineffective approach for fabricating an efficient fluid ejection device.

Accordingly, there persists a need for a fluid ejection device and a method of fabricating the fluid ejection device that are capable of preventing nozzle plate sagging over fluid through vias, fluid ejection misdirection, stretching of the nozzle plate as suspended over the fluid through vias, lamination failure, fluid ingressive attack on the nozzle plate surface, bulging of the nozzle plate, and thus, failure of the fluid ejection device.

SUMMARY OF THE DISCLOSURE

In view of the foregoing disadvantages inherent in the prior art, the general purpose of the present disclosure is to provide fluid ejection devices and methods of fabricating the fluid ejection devices, by including all the advantages of the prior art, and overcoming the drawbacks inherent therein.

In one aspect, the present disclosure provides a fluid ejection device for an inkjet printer. The fluid ejection device includes a substrate having at least one fluid flow channel configured within a bottom portion of the substrate. Each fluid flow channel of the at least one fluid flow channel is configured within the bottom portion by etching the bottom portion at a first predetermined etching rate. The substrate further includes a plurality of fluid flow vias configured within a top portion of the substrate. Each fluid flow via of the plurality of fluid flow vias is configured within the top portion by etching the top portion at a second predetermined etching rate. The each fluid flow via of the plurality of fluid flow vias is further configured to be in fluid communication with a corresponding fluid flow channel of the at least one fluid flow channel through an isotropically etched cavity configured below the each fluid flow via and fluidically coupled to the corresponding fluid flow channel.

The fluid ejection device further includes a flow feature layer configured over the substrate. The flow feature layer includes a plurality of flow feature channels. At least one flow feature channel of the plurality of flow feature channels is in fluid communication with a corresponding fluid flow via of the plurality of fluid flow vias. Furthermore, the fluid ejection device includes a nozzle plate configured over the flow feature layer. The nozzle plate includes a plurality of nozzles. At least one nozzle of the plurality of nozzles is in fluid communication with a corresponding flow feature channel of the plurality of flow feature channels.

In another aspect, the present disclosure provides a method for fabricating a fluid ejection device. The method includes fabricating a plurality of fluid flow vias within a top portion of a substrate by etching the top portion. The method further includes depositing a layer of a protective material over the etched top portion of the substrate, such that the layer of the protective material coats each fluid flow via of the plurality of fluid flow vias. Furthermore, the method includes partially etching the layer of the protective material as coated over the each fluid flow via of the plurality of fluid flow vias. Additionally, the method includes fabricating at least one fluid flow channel within a bottom portion of the substrate by etching the bottom portion.

Moreover, the method include isotropically etching the substrate from the top portion of the substrate and through the each fluid flow via of the plurality of fluid flow vias to form a cavity configured below the each fluid flow via to fluidically couple the each fluid flow via to a corresponding fluid flow channel of the at least one fluid flow channel. The method also includes configuring a flow feature layer over the substrate. In addition, the method includes configuring a plurality of flow feature channels within the flow feature layer such that at least one flow feature channel of the plurality of flow feature channels is in fluid communication with a corresponding fluid flow via of the plurality of fluid flow vias. The method further includes configuring a nozzle plate over the flow feature layer. Furthermore, the method includes configuring a plurality of nozzles within the nozzle plate such that at least one nozzle of the plurality of nozzles is in fluid communication with a corresponding flow feature channel of the plurality of flow feature channels.

In yet another aspect, the present disclosure provides a method for fabricating a fluid ejection device. The method includes depositing a first layer of a protective material over a substrate. The method further includes patterning the first layer of the protective material. Furthermore, the method includes fabricating a plurality of fluid flow vias within a top portion of the substrate by etching the top portion through the patterned first layer of the protective material. The method also includes coating each fluid flow via of the plurality of fluid flow vias with a second layer of the protective material. Additionally, the method includes partially etching the second layer of the protective material as coated over the each fluid flow via of the plurality of fluid flow vias. Moreover, the method includes fabricating at least one fluid flow channel and at least one via bridge within a bottom portion of the substrate by etching the bottom portion. Each via bridge of the at least one via bridge is configured between two adjacent fluid flow channels of the at least one fluid flow channel.

In addition, the method includes isotropically etching the substrate from the top portion of the substrate and through the each fluid flow via of the plurality of fluid flow vias to fluidically couple the each fluid flow via to a corresponding fluid flow channel of the at least one fluid flow channel. The method also includes configuring a flow feature layer over the substrate. Furthermore, the method includes configuring a plurality of flow feature channels within the flow feature layer such that at least one flow feature channel of the plurality of flow feature channels is in fluid communication with a corresponding fluid flow via of the plurality of fluid flow vias. Additionally, the method includes configuring a nozzle plate over the flow feature layer. The method also includes configuring a plurality of nozzles within the nozzle plate such that at least one nozzle of the plurality of nozzles is in fluid communication with a corresponding flow feature channel of the plurality of flow feature channels.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides a fluid ejection device (heater chip) for an inkjet printer. The fluid ejection device includes a substrate that includes at least one fluid flow channel configured within a bottom portion of the substrate. Each fluid flow channel of the at least one fluid flow channel is configured within the bottom portion by etching the bottom portion at a first predetermined etching rate. The substrate further includes a plurality of fluid flow vias configured within a top portion of the substrate. Each fluid flow via of the plurality of fluid flow vias is configured within the top portion by etching the top portion at a second predetermined etching rate. The each fluid flow via of the plurality of fluid flow vias is further being configured to be in fluid communication with a corresponding fluid flow channel of the at least one fluid flow channel through an isotropically etched cavity configured below the each fluid flow via and fluidically coupled to the corresponding fluid flow channel. The fluid ejection device also includes a flow feature layer configured over the substrate. The flow feature layer includes a plurality of flow feature channels, wherein at least one flow feature channel of the plurality of flow feature channels is in fluid communication with a corresponding fluid flow via of the plurality of fluid flow vias. Further, the fluid ejection device includes a nozzle plate configured over the flow feature layer. The nozzle plate includes a plurality of nozzles, wherein at least one nozzle of the plurality of nozzles is in fluid communication with a corresponding flow feature channel of the plurality of flow feature channels. An embodiment of the fluid ejection device of the present disclosure is explained in conjunction with FIGS. 6-9.

Figure 1:
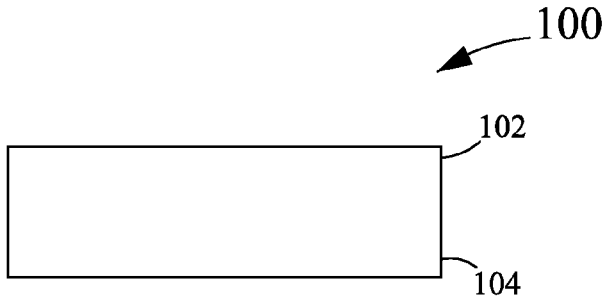
FIGS. 1-4 depict a conventional process flow for configuring fluid through vias within a substrate of a fluid ejection device.
Figure 2:
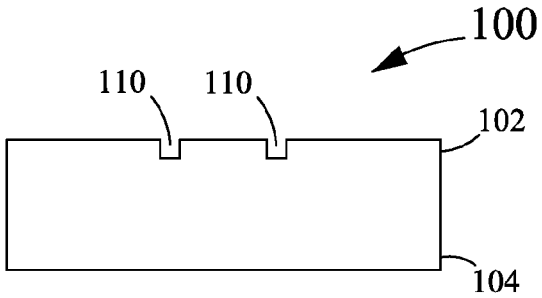
Figure 3:
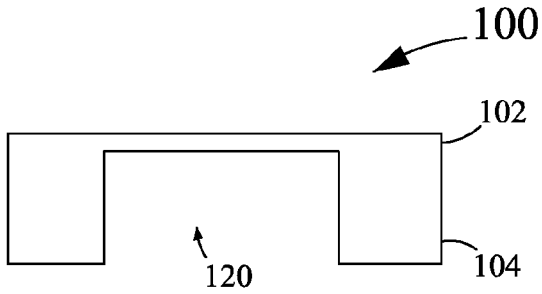
Figure 4:
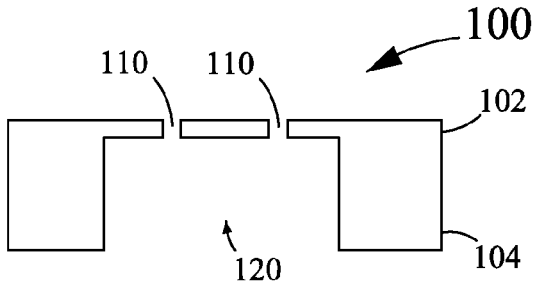
Figure 5:
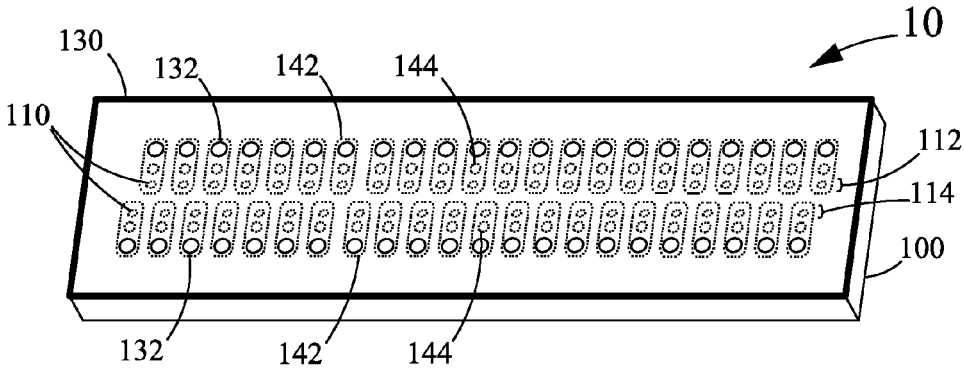
FIG. 5 depicts a top perspective view of the fluid ejection device fabricated using the substrate of FIG. 4.
Figure 6:
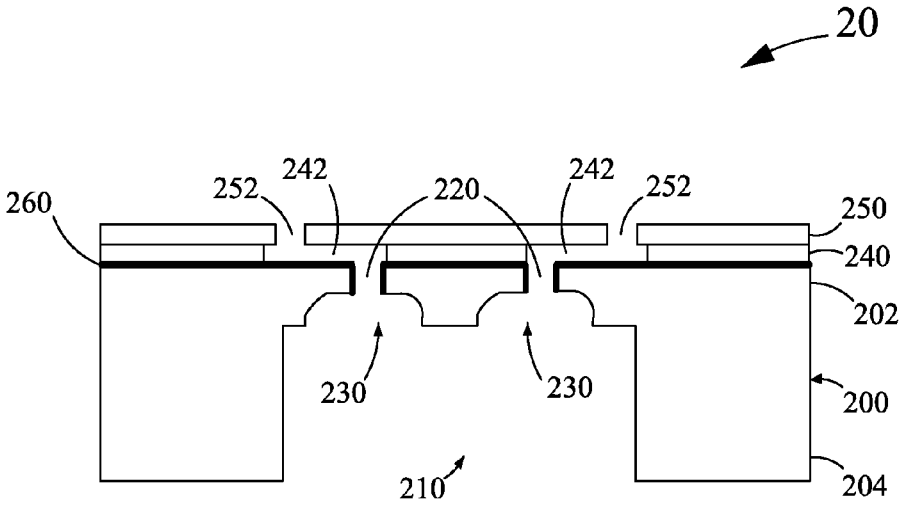
FIG. 6 depicts a side cross-sectional partial view of a fluid ejection device, in accordance with an embodiment of the present disclosure.
Figure 7:
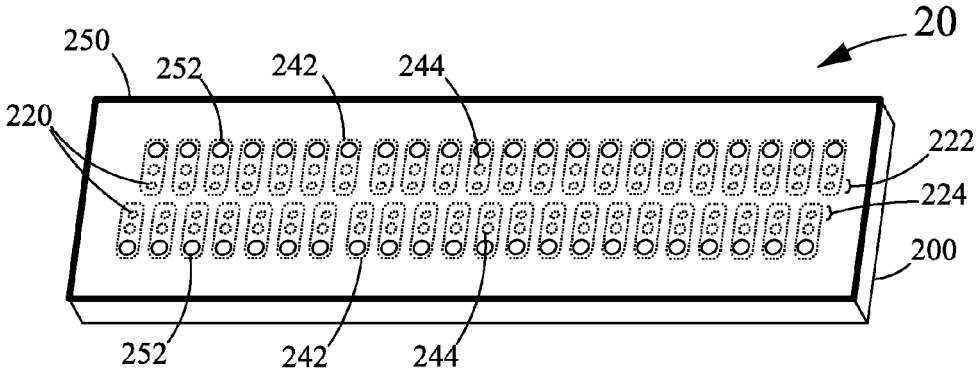
FIG. 7 depicts a top perspective view of the fluid ejection device of FIG. 6.
Figure 8:
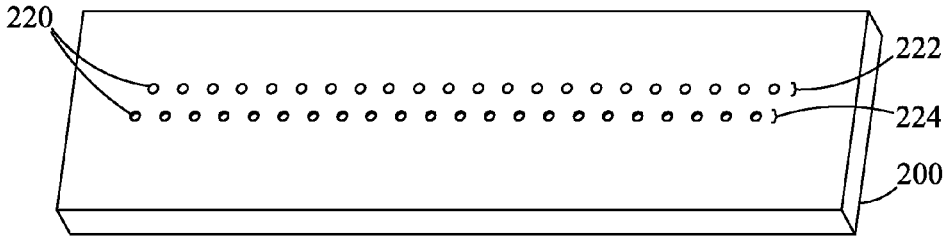
FIG. 8 depicts a top perspective view of a substrate of the fluid ejection device of FIG. 7.
Figure 9:
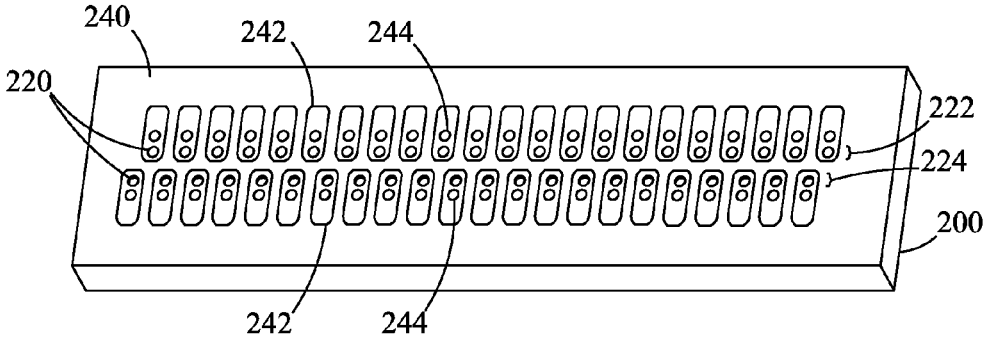
FIG. 9 depicts a top perspective view of the substrate of FIG. 8 illustrating a flow feature layer configured over the substrate.

FIG. 6 depicts a side cross-sectional partial view of a fluid ejection device 20, in accordance with an embodiment of the present disclosure. FIG. 7 depicts a top perspective view of the fluid ejection device 20. FIG. 8 depicts a top perspective view of a substrate of the fluid ejection device 20. FIG. 9 depicts a top perspective view of the substrate illustrating a flow feature layer configured over the substrate.

The fluid ejection device 20 includes a substrate 200 that is a silicon substrate, as depicted in FIGS. 6-9. Without departing from the scope of the present disclosure, any other type of a substrate may be used for the purposes of the present disclosure. The substrate 200 has a top portion 202 and a bottom portion 204, as depicted in FIG. 6. The substrate 200 further includes at least one fluid flow channel, such as a fluid flow channel 210 configured within the bottom portion 204 of the substrate 200, as depicted in FIG. 6. The fluid flow channel 210 is configured within the bottom portion 204 by etching the bottom portion 204 at a first predetermined etching rate. Specifically, the bottom portion 204 is etched by a deep reactive ion etching (DRIE) process at the first predetermined etching rate, such as 25 micrometers per minute (μm/min), for an etching depth of about 50 μm when the substrate 200 is a 400-600 μm thick silicon wafer. It will be evident that the first predetermined etching rate may vary based on the dimension of the substrate 200 and the required depth of the fluid flow channel 210.

It may be evident that FIG. 6 depicts a single fluid flow channel, such as the fluid flow channel 210, only for the purpose of simplicity. However, the substrate 200 may include multiple fluid flow channels.

The substrate 200 also includes a plurality of fluid flow vias 220 configured within the top portion 202 of the substrate 200, as depicted in FIGS. 6-9. Each fluid flow via of the fluid flow vias 220 is configured within the top portion 202 by etching the top portion 202 at a second predetermined etching rate. Specifically, the top portion 202 is etched by a DRIE process. More specifically, the fluid flow vias 220 are fabricated with finely controlled depth within ±1 μm, i.e., the DRIE etching depth is controlled within 1 μm when the etching rate is very low (the second predetermined etching rate), such as 1 μm/min to etch only a skin layer of silicon material from the top portion 202. Accordingly, the first etching rate is faster than the second etching rate.

The each fluid flow via of the fluid flow vias 220 is also configured to be in fluid communication with a corresponding fluid flow channel, and specifically, the fluid flow channel 210, of the at least one fluid flow channel through an isotropically etched cavity 230 configured below the each fluid flow via and fluidically coupled to the fluid flow channel 210. Further, the fluid flow vias 220 are configured over the fluid flow channel 210, as depicted in FIGS. 6 and 7. Specifically, the fluid flow vias 220 are configured in at least one row, such as a first row 222 and a second row 224 parallel to the first row 222, as depicted in FIGS. 7-9, arranged over the fluid flow channel 210. Further, the each fluid flow via of the fluid flow vias 220 may have a shape, such as a circular shape, a rectangular shape and the like, based on a manufacturer's preferences. Furthermore, the each fluid flow via of the fluid flow vias 220 may be uniformly small with a depth ranging from about 10 μm to about 100 μm across the fluid ejection device 20.

The fluid ejection device 20 also includes a flow feature layer 240 configured over the substrate 200, as depicted in FIGS. 6 and 9. The flow feature layer 240 includes a plurality of flow feature channels 242 (connecting fingers), wherein at least one flow feature channel of the flow feature channels 242 is in fluid communication with a corresponding fluid flow via of the fluid flow vias 220. In the present embodiment, only one flow feature channel of the flow feature channels 242 is in fluid communication with a respective corresponding fluid flow via of the fluid flow vias 220, as depicted in FIGS. 6, 7 and 9. Further, the flow feature layer 240 includes a plurality of filtering pillars 244, as depicted in FIGS. 7 and 9. Each filtering pillar of the filtering pillars 244 is configured within a flow feature channel of the flow feature channels 242. The flow feature layer 240, as described herein above, may be laminated and patterned with the flow feature channels 242 and the filtering pillars 244, over the substrate 200.

In addition, the fluid ejection device 20 includes a nozzle plate 250 configured over the flow feature layer 240, as depicted in FIGS. 6 and 7. The nozzle plate 250 includes a plurality of nozzles 252, wherein at least one nozzle of the nozzles 252 is in fluid communication with a corresponding flow feature channel of the flow feature channels 242. In the present embodiment, only one nozzle of the nozzles 252 is in fluid communication with a respective corresponding flow feature channel of the flow feature channels 242. Thus, each nozzle of the nozzles 252 is fed by respective one fluid flow via of the fluid flow vias 220. The nozzle plate 250, as described herein above, is a photo-imaged nozzle plate laminated and patterned with the nozzles 252.

Moreover, the fluid ejection device 20 may include a layer 260 of a protective material deposited over the top portion 202 of the substrate 200, such that the layer 260 of the protective material coats the each fluid flow via of the fluid flow vias 220, as depicted in FIG. 6. Specifically, the layer 260 of the protective material is a layer of silicon oxide that is deposited using techniques, such as low temperature oxide Chemical Vapor Deposition (CVD, at about 350 degrees Celsius), Plasma Enhanced Chemical Vapor Deposition (PECVD), electron beam evaporation, and sputtering.

It may be evident that the fluid ejection device 20 may also include one or more fluid ejections elements (not shown) configured on the substrate 200 for ejecting fluids received from the fluid flow vias 220, through the nozzles 252.

Further, without changing fluid feeding mechanism (arrangement for fluid communication through components of respective fluid ejection device) as disclosed with reference to the fluid ejection device 20, fluidic structures (i.e., fluid flow vias) may also be modified by varying spatial density of the fluid flow vias in a particular fluid ejection device, i.e., a single fluid flow via may feed more than one firing chambers of the fluid ejection device. Embodiments covering such aspects of the present disclosure are explained in conjunction with FIGS. 10-12 and 13-17. It will be evident that a lower spatial density of the fluid flow vias provides the fluidic structures higher mechanical strength that benefits wafer processing; later printhead assembly; and eventual fluid ejection device performance and service life. Further, a wider separation between fluid flow vias may even be favored by power distributions to each fluid ejection element of the fluid ejection device.

Figure 10:
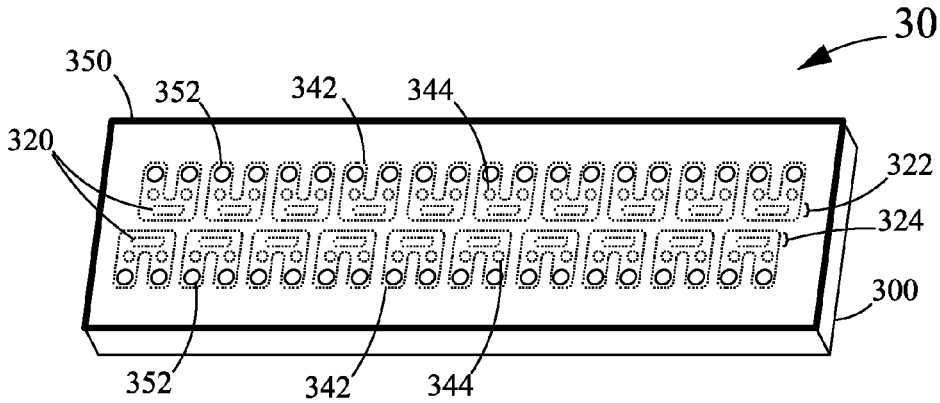
FIG. 10 depicts a top perspective view of a fluid ejection device, in accordance with another embodiment of the present disclosure.
Figure 11:
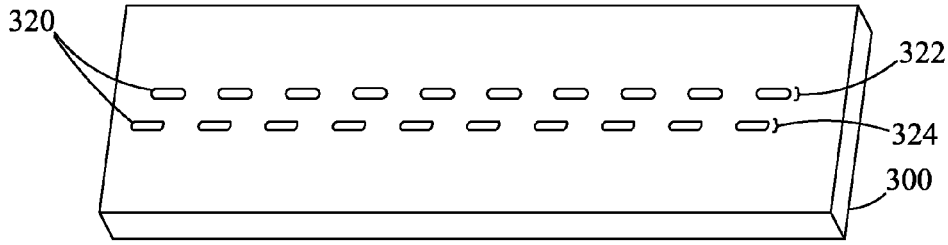
FIG. 11 depicts a top perspective view of a substrate of the fluid ejection device of FIG. 10.
Figure 12:
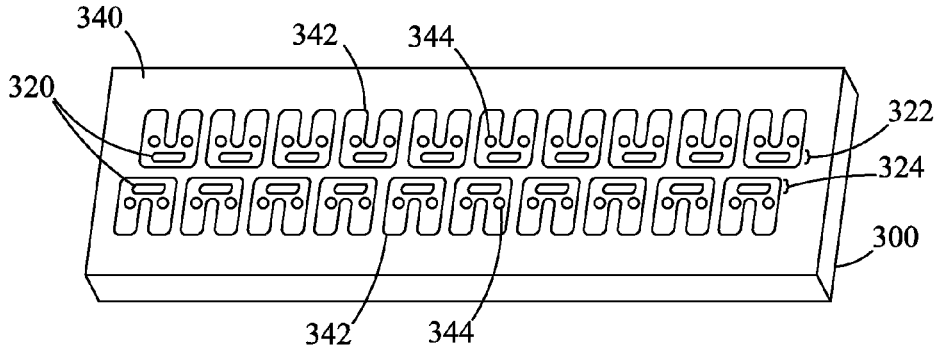
FIG. 12 depicts a top perspective view of the substrate of FIG. 11 illustrating a flow feature layer configured over the substrate.

Based on the foregoing, the present disclosure also provides a fluid ejection device 30, in accordance with another embodiment of the present disclosure. The fluid ejection device 30 is explained in conjunction with FIGS. 10-12. FIG. 10 depicts a top perspective view of the fluid ejection device 30. FIG. 11 depicts a top perspective view of a substrate of the fluid ejection device 30. FIG. 12 depicts a top perspective view of the substrate of the fluid ejection device 30 illustrating a flow feature layer configured over the substrate.

Referring to FIGS. 10-12, the fluid ejection device 30 includes a substrate 300 that is a silicon substrate. Without departing from the scope of the present disclosure, any other type of a substrate may be used for the purposes of the present disclosure. The substrate 300 is similar to the substrate 200 of FIGS. 6-9, and has a top portion (not numbered) and a bottom portion (not numbered). The substrate 300 further includes at least one fluid flow channel (not shown), similar to the fluid flow channel 210, configured within the bottom portion of the substrate 300. Each fluid flow channel of the at least one fluid flow channel is configured within the bottom portion by etching the bottom portion at a first predetermined etching rate. Specifically, the bottom portion is etched by DRIE at the first predetermined etching rate, such as 25 μm/min, for an etching depth of about 50 μm, when the substrate 300 is a 400-600 μm thick silicon wafer. It will be evident that the first predetermined etching rate may vary based on the dimension of the substrate 300 and the required depth of the each fluid flow channel.

The substrate 300 also includes a plurality of fluid flow vias 320 configured within the top portion of the substrate 300, as depicted in FIGS. 10-12. Each fluid flow via of the fluid flow vias 320 is configured within the top portion by etching the top portion at a second predetermined etching rate. Specifically, the top portion is etched by DRIE technique. More specifically, the fluid flow vias 320 are fabricated with finely controlled depth within ±1 μm, i.e., the DRIE etching depth is controlled within 1 μm when the etching rate is very low (the second predetermined etching rate), such as 1 μm/min to etch only a skin layer of silicon material from the top portion. Accordingly, the first etching rate is faster than the second etching rate. Further, the each fluid flow via may have a depth ranging from about Mum to about 100 μm. Furthermore, the each fluid flow via of the fluid flow vias 320 may have a shape, such as a circular shape, a rectangular shape and the like, based on a manufacturer's preferences.

The each fluid flow via of the fluid flow vias 320 is also configured to be in fluid communication with a corresponding fluid flow channel of the at least one fluid flow channel through an isotropically etched cavity (not shown), similar to the isotropically etched cavity 230, configured below the each fluid flow via and fluidically coupled to the corresponding fluid flow channel. Further, the fluid flow vias 320 are configured over the corresponding fluid flow channel. Specifically, the fluid flow vias 320 are configured in at least one row, such as a first row 322 and a second row 324 parallel to the first row 322, as depicted in FIGS. 10-12, arranged over the corresponding fluid flow channel.

The fluid ejection device 30 also includes a flow feature layer 340 configured over the substrate 300, as depicted in FIG. 12. The flow feature layer 340 includes a plurality of flow feature channels 342 (connecting fingers), wherein at least one flow feature channel of the flow feature channels 342 is in fluid communication with a corresponding fluid flow via of the fluid flow vias 320. In the present embodiment, two flow feature channels of the flow feature channels 342 are in fluid communication with a respective corresponding fluid flow via of the fluid flow vias 320, as depicted in FIGS. 10 and 12. Further, the flow feature layer 340 includes a plurality of filtering pillars 344 of an identical size. Each filtering pillar of the filtering pillars 344 is configured within a flow feature channel of the flow feature channels 342. The flow feature layer 340, as described herein above, may be laminated and patterned with the flow feature channels 342 and the filtering pillars 344.

In addition, the fluid ejection device 30 includes a nozzle plate 350 configured over the flow feature layer 340, as depicted in FIG. 10. The nozzle plate 350 includes a plurality of nozzles 352, wherein at least one nozzle of the nozzles 352 is in fluid communication with a corresponding flow feature channel of the flow feature channels 342. In the present embodiment, a single nozzle of the nozzles 352 is in fluid communication with a respective corresponding flow feature channel of the flow feature channels 342, as depicted in FIG. 10. Such an arrangement of the nozzles 352 facilitates in sharing of one fluid flow via of the fluid flow vias 320 by two nozzles of the nozzles 352. The nozzle plate 350, as described herein above, is a photo-imaged nozzle plate laminated and patterned with the nozzles 352. It is to be understood that FIG. 10 depicts the nozzles 352 with the underneath flow feature channels 342 and flow fluid vias 320, which otherwise will be hidden when viewed from the top perspective view, only for the purpose of explanation.

It may be evident that the fluid ejection device 30 may include one or more fluid ejections elements (not shown) configured on the substrate 300 for ejecting fluids received from the fluid flow vias 320, through the nozzles 352.

Figure 13:
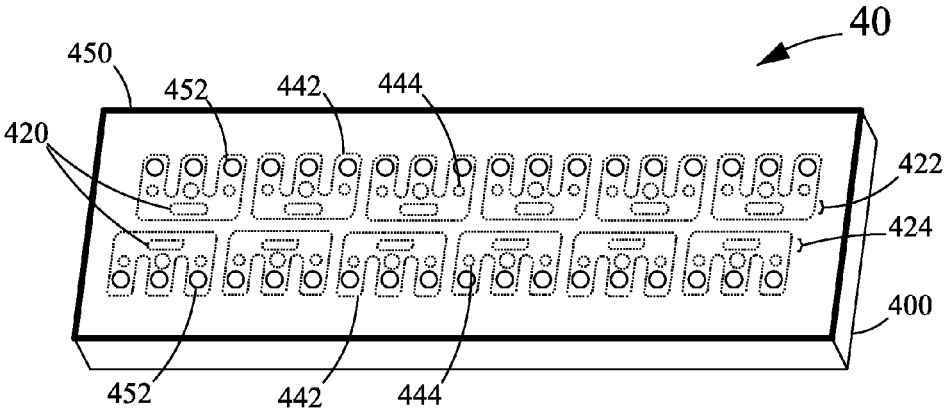
FIG. 13 depicts a top perspective view of a fluid ejection device, in accordance with yet another embodiment of the present disclosure.
Figure 14:
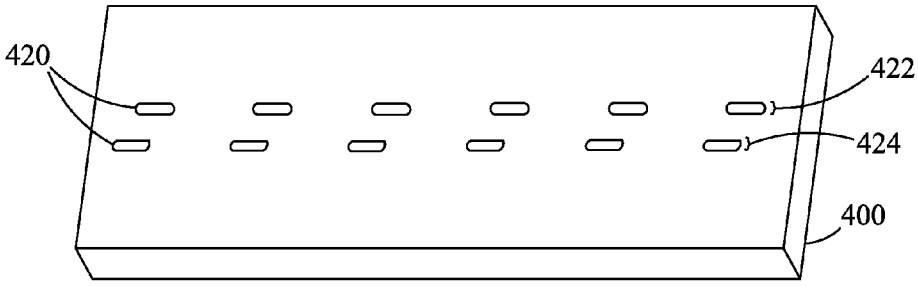
FIG. 14 depicts a top perspective view of a substrate of the fluid ejection device of FIG. 13.
Figure 15:
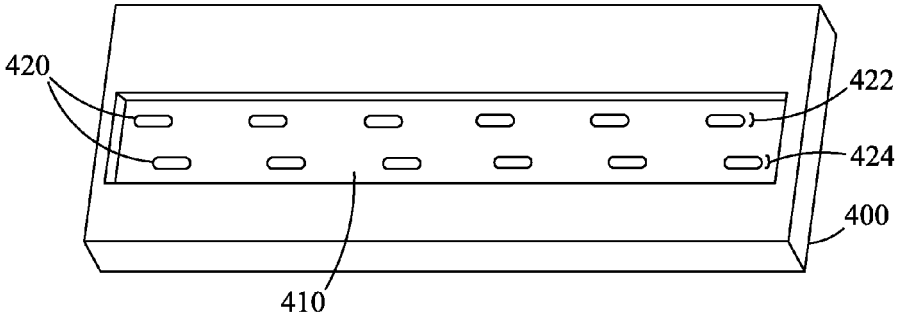
FIG. 15 depicts a bottom perspective view of the substrate of FIG. 14.
Figure 16:
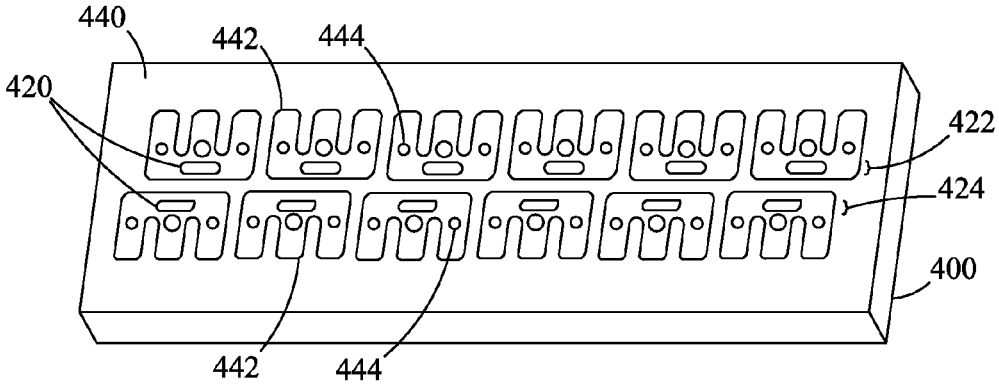
FIG. 16 depicts a top perspective view of the substrate of FIG. 14 illustrating a flow feature layer configured over the substrate.
Figure 17:
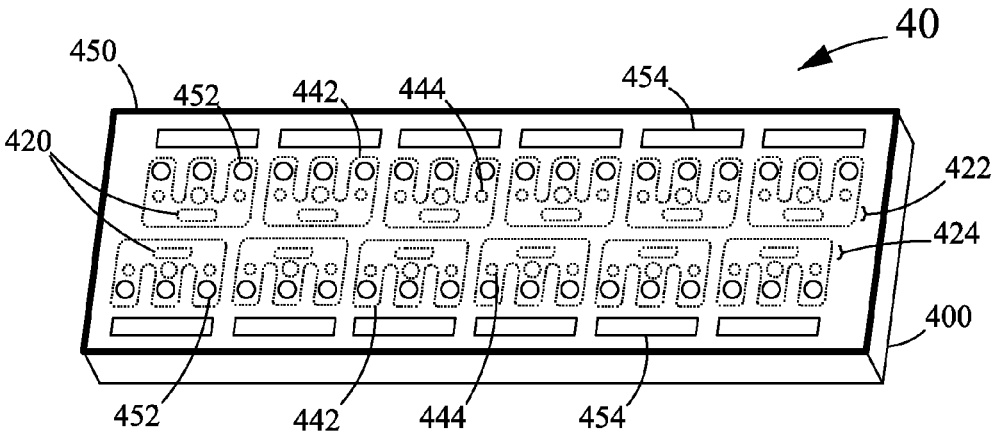
FIG. 17 depicts a top perspective view of the fluid ejection device of FIG. 13 illustrating a plurality of trenches patterned in a nozzle plate of the fluid ejection device.

The present disclosure also provides a fluid ejection device 40, in accordance with yet another embodiment of the present disclosure. FIG. 13 depicts a top perspective view of the fluid ejection device 40. FIG. 14 depicts a top perspective view of a substrate of the fluid ejection device 40. FIG. 15 depicts a bottom perspective view of the substrate of the fluid ejection device 40. FIG. 16 depicts a top perspective view of the substrate of the fluid ejection device 40 illustrating a flow feature layer configured over the substrate. FIG. 17 depicts a top perspective view of the fluid ejection device 40 illustrating a plurality of trenches patterned in a nozzle plate of the fluid ejection device 40.

Referring to FIGS. 13-17, the fluid ejection device 40 includes a substrate 400 that is a silicon substrate. Without departing from the scope of the present disclosure, any other type of a substrate may be used for the purposes of the present disclosure. The substrate 400 is similar to the substrates 200 and 300 of FIGS. 6-12, and has a top portion (not numbered) and a bottom portion (not numbered). As depicted in FIG. 15, the substrate 400 further includes at least one fluid flow channel, such as a fluid flow channel 410, similar to the fluid flow channel 210, configured within the bottom portion of the substrate 400. The fluid flow channel 410 is configured within the bottom portion by etching the bottom portion at a first predetermined etching rate. Specifically, the bottom portion is etched by DRIE at the first predetermined etching rate, such as 25 μm/min, for an etching depth of about 50 μm when the substrate 400 is a 400-600 μm thick silicon wafer. It will be evident that the first predetermined etching rate may vary based on the dimension of the substrate 400 and the required depth of the fluid flow channel 410.

The substrate 400 also includes a plurality of fluid flow vias 420 configured within the top portion of the substrate 400, as depicted in FIGS. 13-17. The fluid flow vias 420 are similar to fluid flow vias 220 and 320, and accordingly, a description of the fluid flow vias 420 is herein avoided for the sake of brevity. The each fluid flow via of the fluid flow vias 420 is also configured to be in fluid communication with the fluid flow channel 410 through an isotropically etched cavity (not shown), similar to the isotropically etched cavity 230, configured below the each fluid flow via and fluidically coupled to the fluid flow channel 410. Further, the fluid flow vias 420 are configured in at least one row, such as a first row 422 and a second row 424 parallel to the first row 422, as depicted in FIGS. 13-17, arranged over the fluid flow channel 410. Further, the each fluid flow via of the fluid flow vias 420 may have a shape, such as a circular shape, a rectangular shape and the like, based on a manufacturer's preferences. Furthermore, the each fluid flow via of the fluid flow vias 420 may be uniformly small with a depth ranging from about 10 μm to about 100 μm across the fluid ejection device 40.

The fluid ejection device 40 also includes a flow feature layer 440 configured over the substrate 400, as depicted in FIG. 16. The flow feature layer 440 includes a plurality of flow feature channels 442 (connecting fingers), wherein at least one flow feature channel of the flow feature channels 442 is in fluid communication with a corresponding fluid flow via of the fluid flow vias 420. In the present embodiment, three flow feature channels of the flow feature channels 442 are in fluid communication with a respective corresponding fluid flow via of the fluid flow vias 420, as depicted in FIGS. 13, 16 and 17. Further, the flow feature layer 440 includes a plurality of filtering pillars 444. Each filtering pillar of the filtering pillars 444 is configured within a flow feature channel of the flow feature channels 442. Specifically, the filtering pillars 444 are distributed in groups of three with a central large filtering pillar aligned with a corresponding fluid flow via of the fluid flow vias 420 for uniform fluidic resistance. The flow feature layer 440, as described herein above, may be laminated and patterned with the flow feature channels 442 and the filtering pillars 444.

In addition, the fluid ejection device 40 includes a nozzle plate 450 configured over the flow feature layer 440, as depicted in FIGS. 13 and 17. The nozzle plate 450 includes a plurality of nozzles 452, wherein at least one nozzle of the nozzles 452 is in fluid communication with a corresponding flow feature channel of the flow feature channels 442. In the present embodiment, a single nozzle of the nozzles 452 is in fluid communication with a respective corresponding flow feature channel of the flow feature channels 442, as depicted in FIGS. 13 and 17. Such an arrangement of the nozzles 452 facilitates in sharing of one fluid flow via of the fluid flow vias 420 by three nozzles of the nozzles 452. As depicted in FIG. 17, the nozzle plate 450 may also include optionally patterned trenches, such as a plurality of trenches 454 along longitudinal sides (not numbered) thereof, to prevent mixing of fluids. It is to be understood that FIGS. 13 and 17 depict the nozzles 452 with the underneath flow feature channels 442 and flow fluid vias 420, which otherwise will be hidden when viewed from the top perspective view, only for the purpose of explanation. The nozzle plate 450, as described herein above, is a photo-imaged nozzle plate that is laminated and patterned to configure the respective nozzles 452.

It may be evident that the fluid ejection device 40 may include one or more fluid ejections elements (not shown) configured on the substrate 400 for ejecting fluids received from the fluid flow vias 420, through the nozzles 452.

Figure 18:
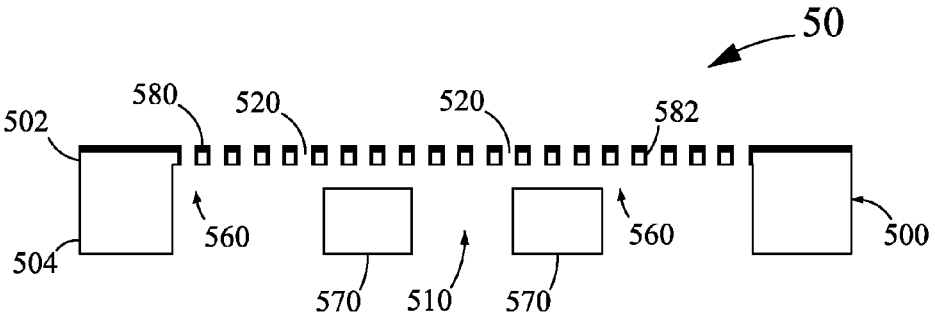
FIG. 18 depicts a side cross-sectional partial view of a fluid ejection device (without a flow feature layer and a nozzle plate), in accordance with still another embodiment of the present disclosure.
Figure 19:
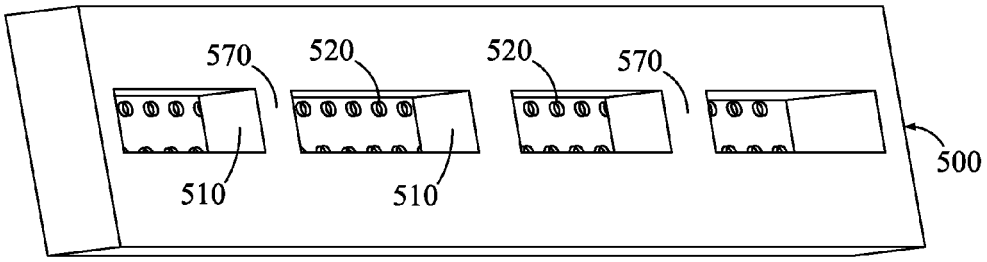
FIG. 19 depicts a bottom perspective view of a substrate of the fluid ejection device of FIG. 18.

The present disclosure also provides a fluid ejection device 50, in accordance with still another embodiment of the present disclosure. FIG. 18 depicts a side cross-sectional partial view of the fluid ejection device 50, and more specifically, of a substrate of the fluid ejection device 50. It will be evident that the fluid ejection device 50 is shown without any flow feature layer and nozzle plate, only for the purposes of simplicity. FIG. 19 depicts a bottom perspective view of the substrate of the fluid ejection device 50 of FIG. 18.

Referring to FIG. 18, the fluid ejection device 50 includes a substrate 500 that is a silicon substrate. Without departing from the scope of the present disclosure, any other type of a substrate may be used for the purposes of the present disclosure. The substrate 500 is similar to the substrates 200, 300 and 400 of FIGS. 6-17, and has a top portion 502 and a bottom portion 504. As depicted in FIGS. 18 and 19, the substrate 500 further includes at least one fluid flow channel. In the present embodiment, the substrate 500 includes a plurality of fluid flow channels 510, similar to the fluid flow channel 210, configured within the bottom portion 504 of the substrate 500. The fluid flow channels 510 are configured within the bottom portion 504 by etching the bottom portion 504 at a first predetermined etching rate. Specifically, the bottom portion 504 is etched by DRIE at the first predetermined etching rate, such as 25 μm/min, for an etching depth of about 50 μm when the substrate 500 is a 400-600 μm thick silicon wafer. It will be evident that the first predetermined etching rate may vary based on the dimension of the substrate 500 and the required depth of the fluid flow channels 510.

The substrate 500 also includes a plurality of fluid flow vias 520 configured within the top portion 502 of the substrate 500, as depicted in FIG. 18. The fluid flow vias 520 are similar to the fluid flow vias 220, 320 and 420, and accordingly, a description of the fluid flow vias 520 is herein avoided for the sake of brevity. Each fluid flow via of the fluid flow vias 520 is also configured to be in fluid communication with a corresponding fluid flow channel of the fluid flow channels 510 through an isotropically etched cavity (not shown), similar to the isotropically etched cavity 230, configured below the each fluid flow via and fluidically coupled to the corresponding fluid flow channel. Isotropically etched cavities under respective fluid flow vias 520 result in the formation of a plurality of channels 560, as depicted in FIG. 18. Further, the fluid flow vias 520 are configured in at least one row, such as a first row (not shown) and a second row (not shown) parallel to the first row arranged over respective fluid flow channels of the fluid flow channels 510. Furthermore, adjacent fluid flow vias of the fluid flow vias 520 may be arranged at a spacing of about 28.22 μm for achieving 1800 dots per inch resolution. Also, the each fluid flow via of the fluid flow vias 520 may have a shape, such as a circular shape, a rectangular shape and the like, based on a manufacturer's preferences. Furthermore, the each fluid flow via of the fluid flow vias 520 may be uniformly small with a depth ranging from about 10 μm to about 100 μm across the fluid ejection device 50.

In addition, the substrate 500 includes at least one via bridge. In the present embodiment, the substrate 500 includes a plurality of via bridges 570. Each via bridge of the via bridges 570 is configured within the bottom portion 504 of the substrate 500 and between two adjacent fluid flow channels of the fluid flow channels 510. The presence of the via bridges 570 assists in improving the mechanical strength of the fluid ejection device 50.

The fluid ejection device 50 may also include a flow feature layer (not shown) configured over the substrate 500. The flow feature layer may include a plurality of flow feature channels (not shown), wherein at least one flow feature channel of the plurality of flow feature channels may be in fluid communication with a corresponding fluid flow via of the fluid flow vias 520. Further, the flow feature layer may include a plurality of filtering pillars (not shown). Each filtering pillar of the plurality of filtering pillars may be configured within a flow feature channel of the plurality of flow feature channels. In addition, the fluid ejection device 50 may include a nozzle plate (not shown) configured over the flow feature layer. The nozzle plate may include a plurality of nozzles (not shown), wherein at least one nozzle of the plurality of nozzles is in fluid communication with a corresponding flow feature channel of the plurality of flow feature channels. Further, each nozzle of the plurality of nozzles may be fed by a single corresponding fluid flow via of the fluid flow vias 520. The nozzle plate may also include optionally patterned trenches to prevent mixing of fluids. The flow feature layer and the nozzle plate may be laminated and patterned to configure the respective plurality of flow feature channels and the plurality of nozzles.

In addition, the fluid ejection device 50 may include a first layer 580 of a protective material deposited over the substrate 500. Specifically, the first layer 580 of the protective material may be a silicon oxide layer (protective overcoat) with a thickness of about 0.5-2 μm. Further, the each fluid flow via of the fluid flow vias 520 may be partially coated with a second layer 582 of the protective material. Specifically, the second layer 582 may be a silicon oxide layer with thickness ranging from about 0.1 μm to about 0.5 μm, conformally coated by a technique such as CVD (about 350 degrees Celsius), PECVD (process at about 300 degrees Celsius) and sputtering.

It may be evident that the fluid ejection device 50 may include one or more fluid ejections elements (not shown) configured on the substrate 500 for ejecting fluids received from the fluid flow vias 520, through the plurality of nozzles.

Figure 20A:
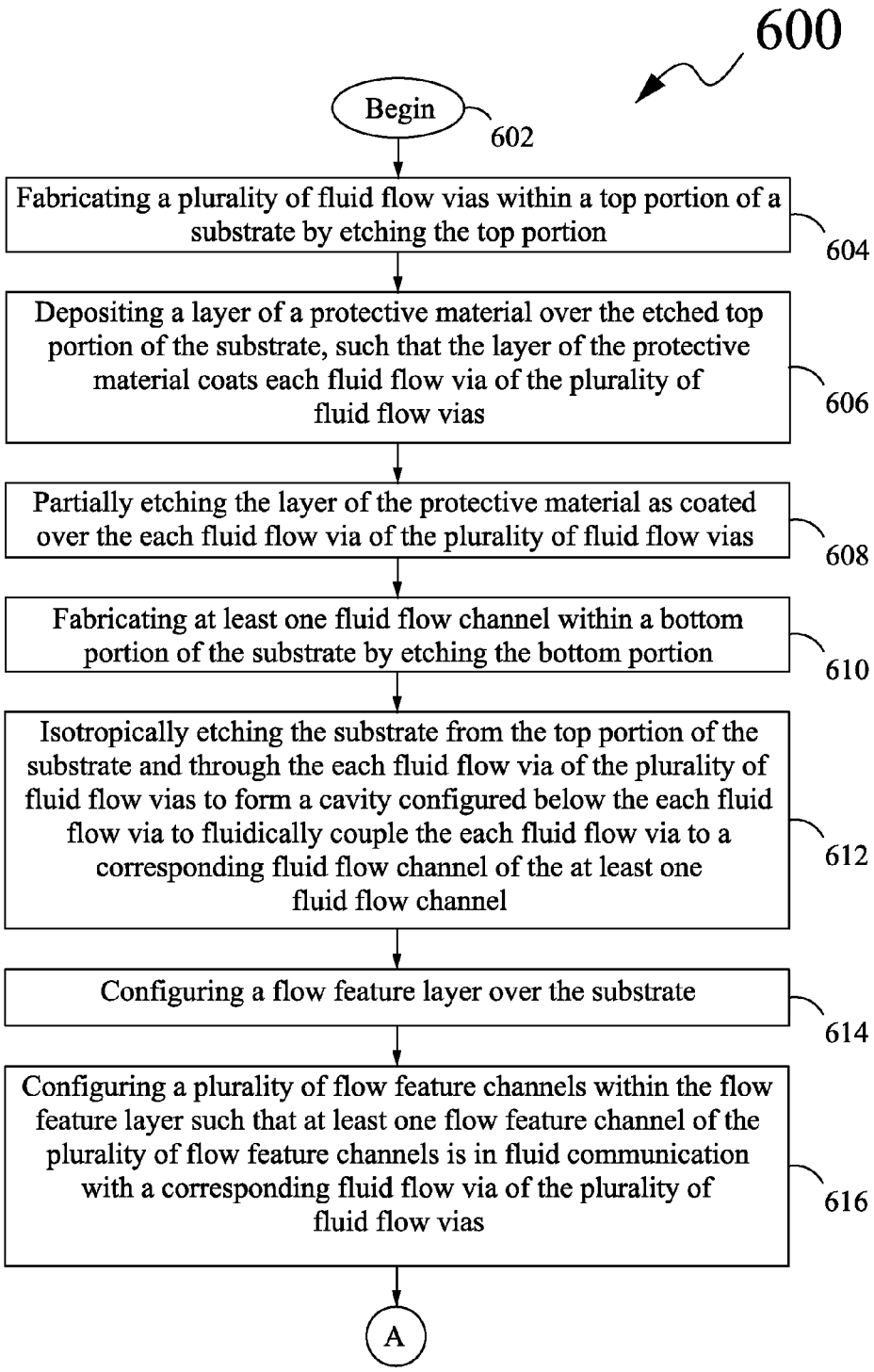
FIGS. 20A and 20B illustrate a flow diagram depicting a method for fabrication of a fluid ejection device, in accordance with an embodiment of the present disclosure.
Figure 20B:
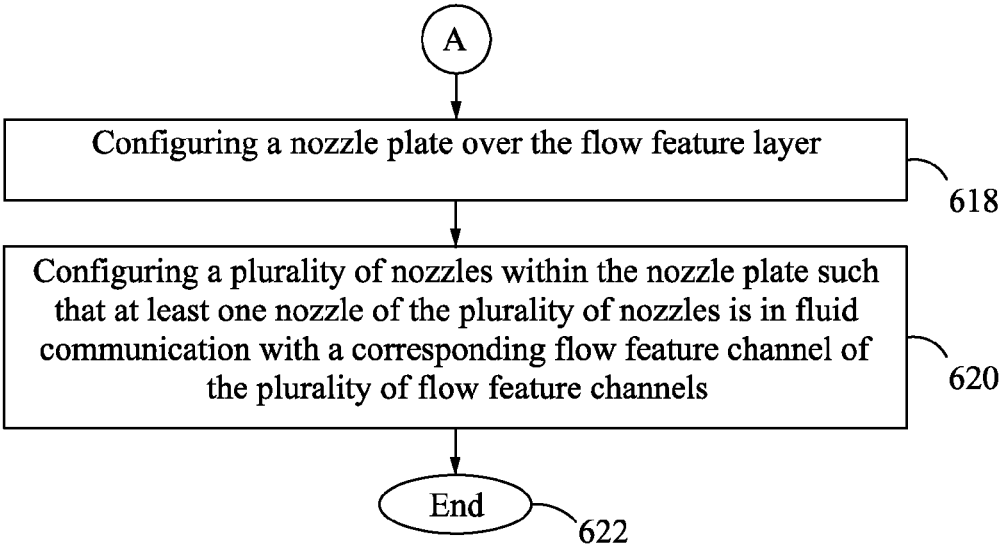

In another aspect, the present disclosure provides a method 600 for fabrication of a fluid ejection device, such as the fluid ejection devices 20, 30 and 40, in accordance with an embodiment of the present disclosure. FIGS. 20A and 20B illustrate a flow diagram depicting the method 600 for fabrication of a fluid ejection device, and more specifically, the fluid ejection device 20. FIGS. 21-26 depict a process flow for fabrication of the fluid ejection device 20. The method 600 is explained in conjunction with the fluid ejection device 20, and accordingly, reference will also be made to FIGS. 6-9.

Figure 21:
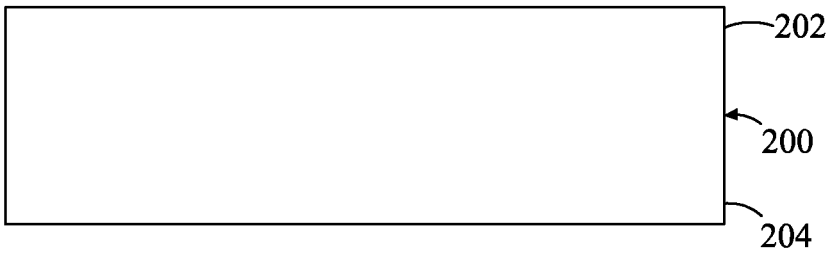
FIGS. 21-26 depict a process flow for fabrication of the fluid ejection device using the method of FIGS. 20A and 20B.
Figure 22:
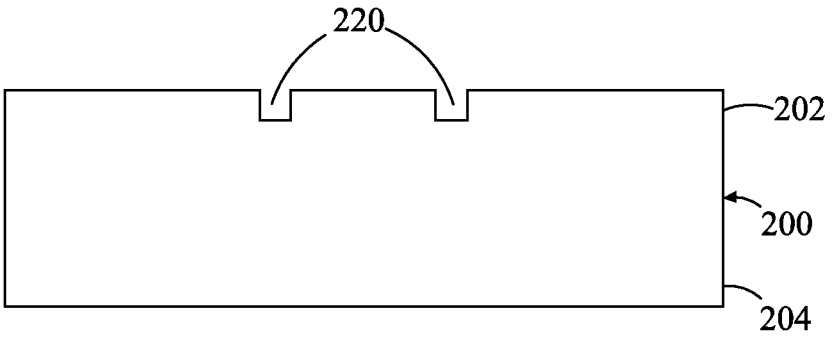
Figure 23:
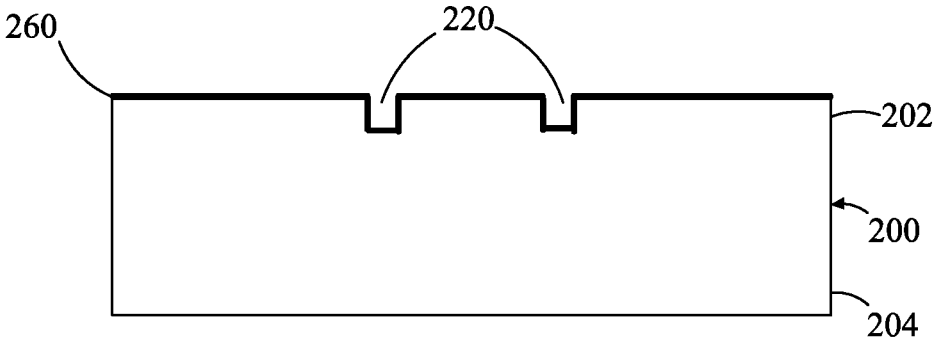

As depicted in FIGS. 20A and 20B, the method 600 begins at 602. Specifically, a substrate (silicon wafer), such as the substrate 200 is provided, as depicted in FIG. 21. The substrate 200 is shown to be without any fluidic structure (i.e., fluid flow vias, fluid flow channels and the like). At 604, a plurality of fluid flow vias, such as the fluid flow vias 220 are fabricated within the top portion 202 of the substrate 200 by etching the top portion 202, as depicted in FIG. 22. Specifically, the top portion 202 is etched by a DRIE process at the second predetermined etching rate. The second predetermined etching rate is a very low etching rate for fine depth control. Further, each fluid flow via is configured to have a depth ranging from about 10 μm to about 100 μm. At 606, the layer 260 of the protective material is deposited over the etched top portion 202 of the substrate 200, such that the layer 260 of the protective material coats the each fluid flow via of the fluid flow vias 220, as depicted in FIG. 23. Specifically, the layer 260 of the protective material is a layer of silicon oxide that is deposited using techniques, such as low temperature oxide CVD (at about 350 degrees Celsius), PECVD, electron beam evaporation, and sputtering.

Figure 24:
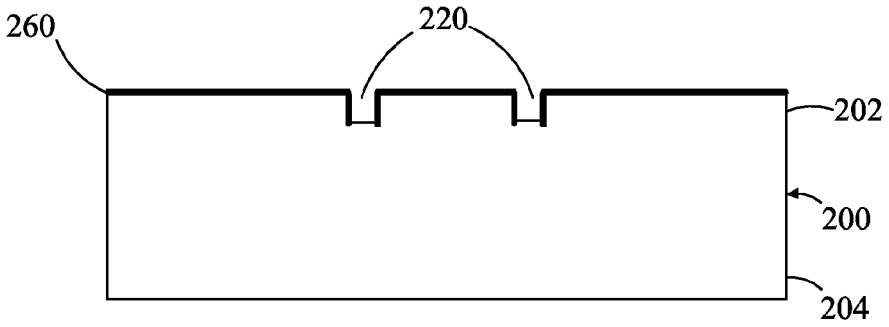
Figure 25:
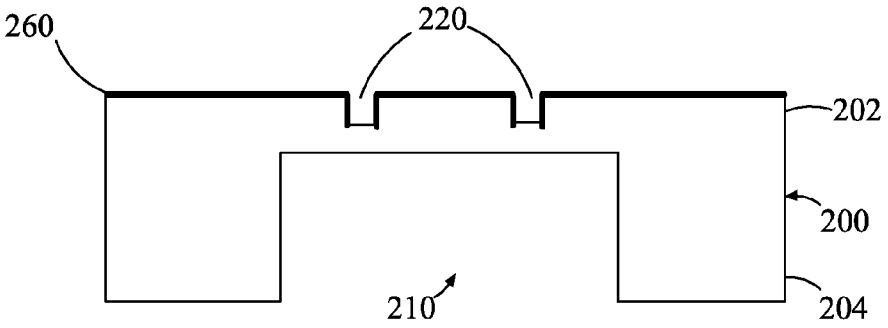

At 608, the layer 260 of the protective material as coated over the each fluid flow via of the fluid flow vias 220 is partially etched, as depicted in FIG. 24. Specifically, the layer 260 of the protective material is etched by a DRIE process at bottom portions (not numbered) of the each fluid flow via. At 610, the at least one fluid flow channel, such as the fluid flow channel 210 is fabricated within the bottom portion 204 of the substrate 200 by etching the bottom portion 204, as depicted in FIG. 25. Specifically, the bottom portion 204 is etched by a DRIE process up to a depth window (not numbered) excluding the fluid flow vias 220, at the first predetermined etching rate that is faster than the second predetermined etching rate. As depicted in FIG. 25, the fluid flow vias 220 are configured in at least one row (such as the first row 222 and the second row 224) arranged over the fluid flow channel 210 of the at least one fluid flow channel.

Figure 26:
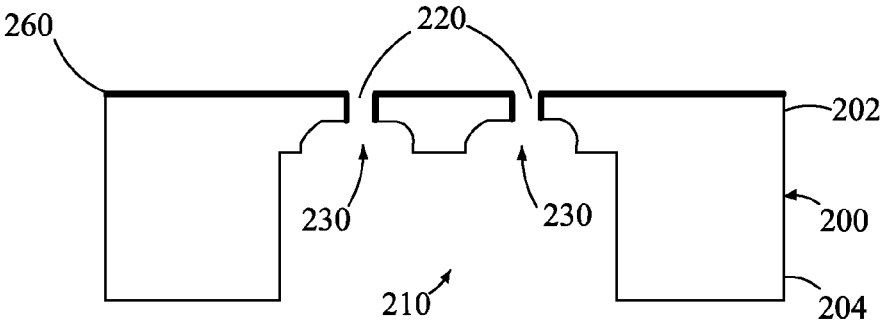

At 612, the substrate 200 is isotropically etched from the top portion 202 of the substrate 200 and through the each fluid flow via of the fluid flow vias 220 to form a cavity, such as the isotropically etched cavity 230, configured below the each fluid flow via to fluidically couple the each fluid flow via to the fluid flow channel 210 of the at least one fluid flow channel, as depicted in FIG. 26. Specifically, the substrate 200 is isotropically etched using a technique such as Sulfur hexafluoride ($SF_6$) plasma technique and Xenon difluoride ($XeF_2$) gas etching technique, from the each fluid flow via of the fluid flow vias 220 to form balloon-shaped cavities (the isotropically etched cavity 230) to connect the fluid flow vias 220 and the fluid flow channel 210.

At 614, the flow feature layer 240 is configured over the substrate 200, as depicted in FIG. 6. At 616, the flow feature channels 242 are configured within the flow feature layer 240 such that the at least one flow feature channel of the flow feature channels 242 is in fluid communication with the corresponding fluid flow via of the fluid flow vias 220. The filtering pillars 444 may also be configured within the flow feature layer 240. At 618, the nozzle plate 250 is configured over the flow feature layer 240. At 620, the nozzles 252 are configured within the nozzle plate 250 such that the at least one nozzle of the nozzles 252 is in fluid communication with the corresponding flow feature channel of the flow feature channels 242. The flow feature layer 240, the flow feature channels 242, the nozzle plate 250, and the nozzles 252 are configured using techniques known in the art. Specifically, the flow feature layer 240 may be patterned over the substrate 200 and the nozzle plate 250 may be patterned over the flow feature layer 240. Therefore, after the fabrication of fluidic structures, i.e., the fluid flow vias 220 and the fluid flow channel 210, the flow feature layer 240 may be coated through lamination, and possibly spin-on with the fluid flow vias 220 filled with sacrificial materials (such as thermally decomposable polymer, spin-on-glass material, and CVD silicon oxide, and the like, as known in the art). The flow feature channels 242 and the filtering pillars 444 may then be lithographically patterned. Subsequently, a PINP process may be used to form the nozzles 452 through traditional photolithography technique following dry film lamination. The method 600 ends at 622.

It is to be understood that although the method 600 has been explained for the fabrication of the fluid ejection device 20, the method 600 may also be used for the fabrication of the fluid ejection devices 30 and 40.

Figure 27A:
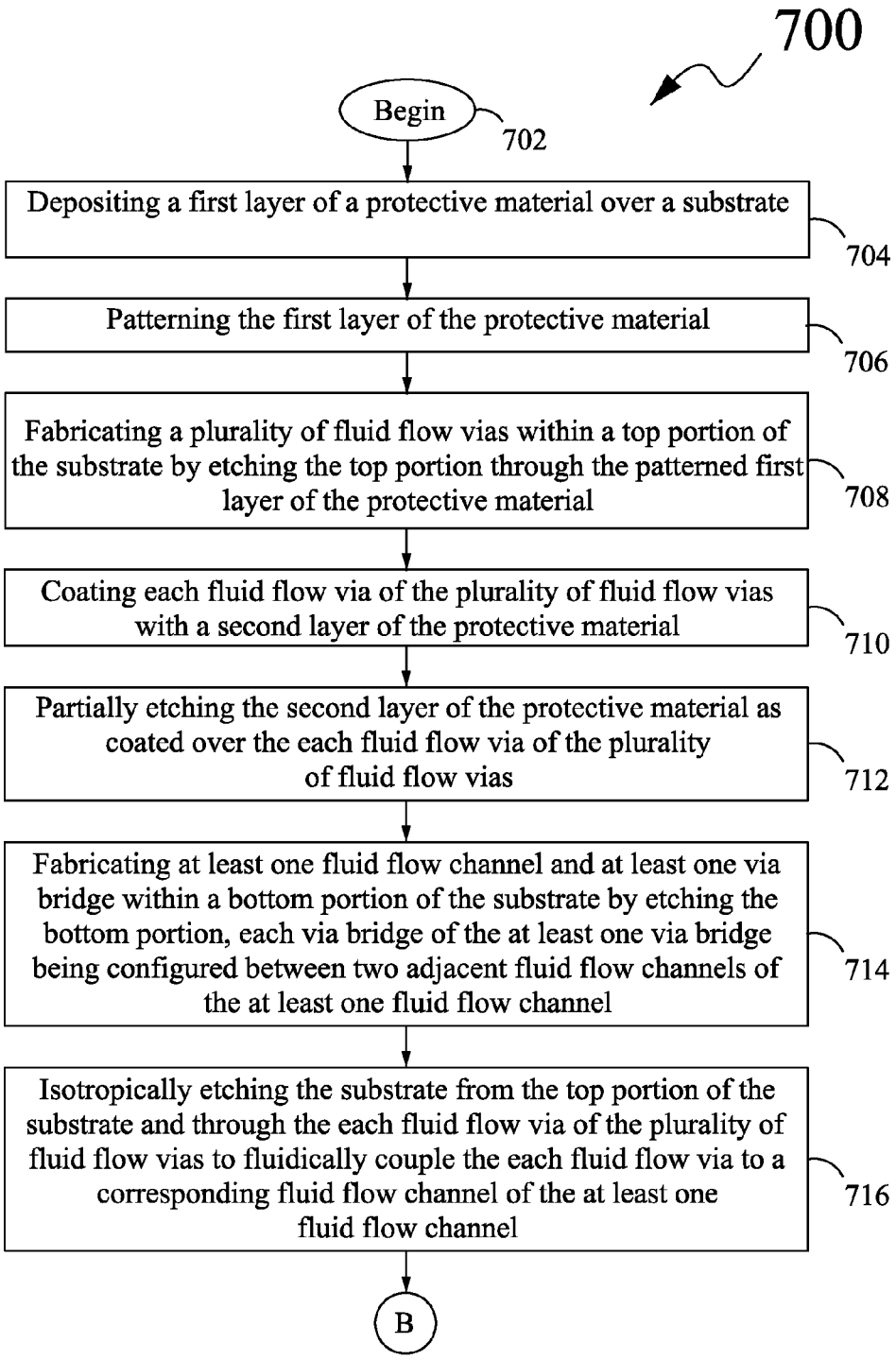
FIGS. 27A and 27B illustrate a flow diagram depicting a method for fabrication of a fluid ejection device, in accordance with another embodiment of the present disclosure.
Figure 27B:
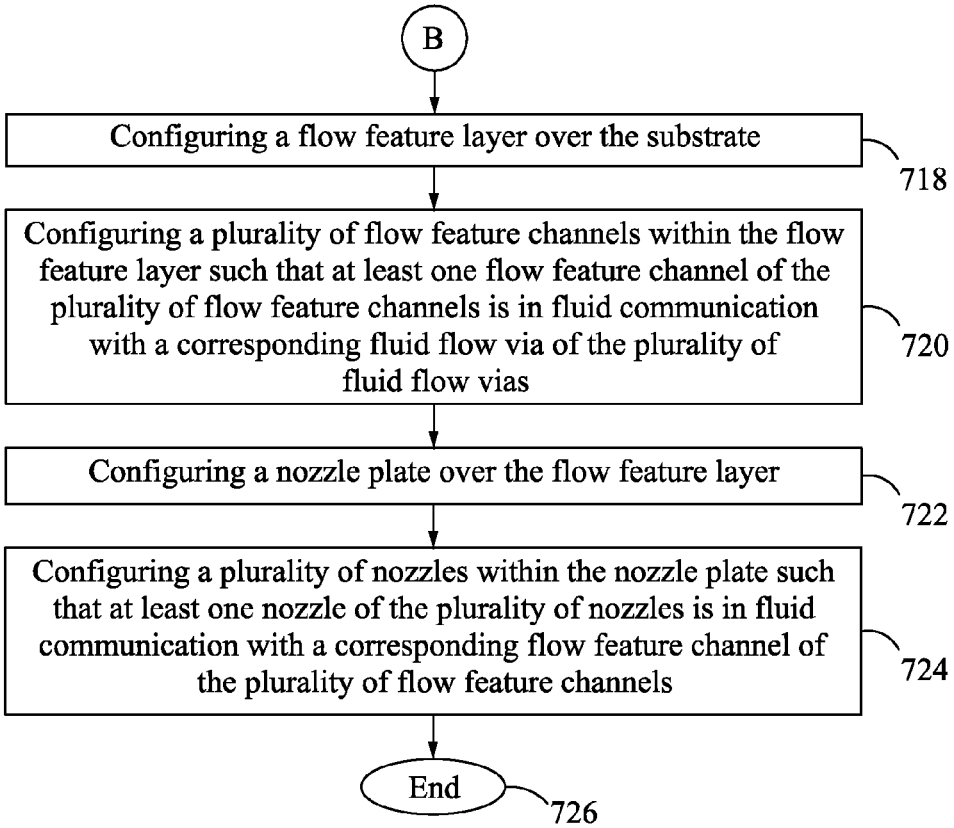

According to another embodiment of the present disclosure, a method for fabricating a fluid ejection device, such as the fluid ejection device 50, is disclosed. FIGS. 27A and 27B illustrate a flow diagram depicting a method 700 for fabrication of the fluid ejection device 50. FIGS. 28-34 depict a process flow for fabrication of the fluid ejection device 50. The method 700 is explained in conjunction with the fluid ejection device 50, and accordingly, reference will also be made to FIGS. 18-19.

Figure 28:
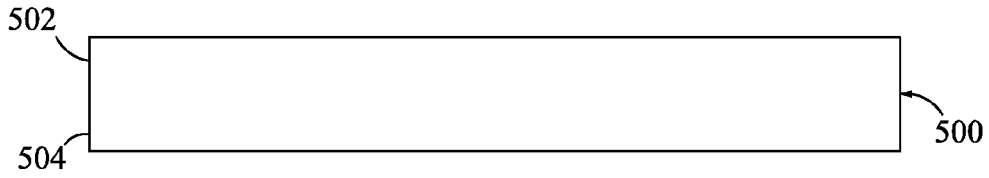
FIGS. 28-34 depict a process flow for fabrication of the fluid ejection device, using the method of FIGS. 27A and 27B.
Figure 29:
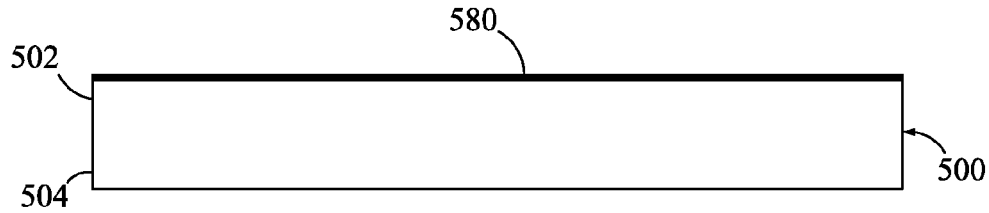

The method 700 begins at 702. Specifically, a substrate (silicon wafer), such as the substrate 500 is provided, as depicted in FIG. 28. The substrate 500 is shown to be without any fluidic structure (i.e., fluid flow vias, fluid flow channels and the like). At 704, the first layer 580 of the protective material is deposited over the substrate 500, as depicted in FIG. 29. Specifically, the first layer 580 of the protective material is a layer of 0.5-2 μm thick silicon oxide protective overcoat.

Figure 30:
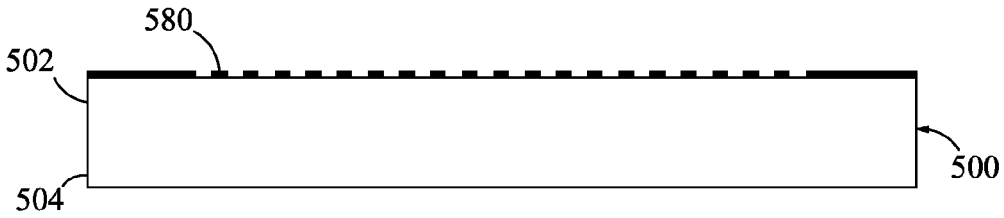
Figure 31:
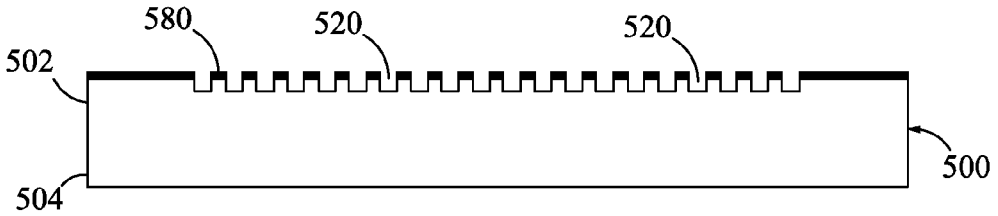

At 706, the first layer 580 of the protective material is patterned, as depicted in FIG. 30. Specifically, the first layer 580 of the protective material is patterned with a mask conformal to the fluid flow vias 520, by a technique such as Buffered Oxide Etch (BOE) and Tetrafluoromethane ($CF_4$) plasma etching. At 708, the fluid flow vias 520 are fabricated within the top portion 502 of the substrate 500 by etching the top portion 502 through the patterned first layer 580 of the protective material, as depicted in FIG. 31. Specifically, the top portion 502 is etched by a DRIE process at the second predetermined etching rate in order to form 10 μm to 100 μm deep fluid flow vias 520. Further, the fluid flow vias 520 are configured in at least one row, such as the first row and the second row, arranged over the each fluid flow channel of the fluid flow channels 510.

Figure 32:
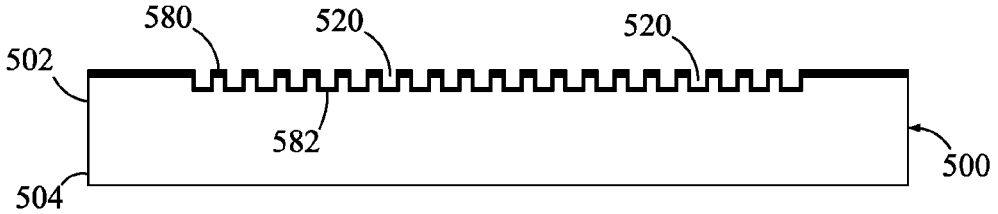

At 710, each fluid flow via of the fluid flow vias 520 is coated with the second layer 582 of the protective material, as depicted in FIG. 32. Specifically, the second layer 582 is a silicon oxide layer with a thickness ranging from about 0.1 μm to about 0.5 μm, conformally coated by a technique such as CVD (at about 350 degrees Celsius), PECVD (process at about 300 degrees Celsius) and sputtering.

Figure 33:
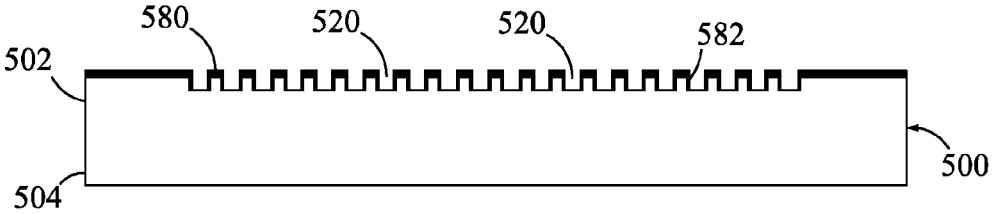

At 712, the second layer 582 of the protective material as coated over the each fluid flow via of the fluid flow vias 520 is partially etched, as depicted in FIG. 33. Specifically, the second layer 582 of the protective material is etched at bottom portions (not numbered) of the fluid flow vias 520, by a technique such as $CF_4$ plasma etching.

Figure 34:
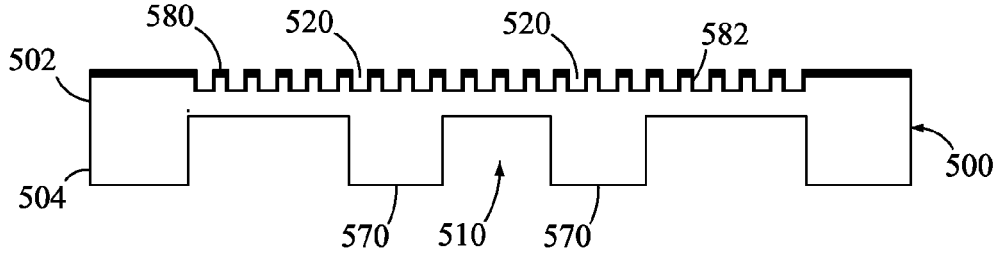

At 714, at least one fluid flow channel, such as the fluid flow channels 510, and at least one via bridge, such as the via bridges 570, are fabricated within the bottom portion 504 of the substrate 500 by etching the bottom portion 504, as depicted in FIG. 34. Specifically, silicon material from the bottom portion 504 is etched by a DRIE process from backside of the substrate 500 with the via bridges 570, and the etching process is timed for a depth window (not numbered) to be outside of the bottom portions of the fluid flow vias 520. The each via bridge of the via bridges 570 is configured between two adjacent fluid flow channels of the fluid flow channels 510. The bottom portion 504 is etched by a DRIE process at the first predetermined etching rate that is faster than the second predetermined etching rate.

At 716, the substrate 500 is isotropically etched from the top portion 502 thereof and through the each fluid flow via of the fluid flow vias 520 to fluidically couple the each fluid flow via to the corresponding fluid flow channel of the fluid flow channels 510, in order to form the fluid ejection device 50 of FIG. 18. Specifically, silicon material from the top portion 502 is isotropically etched from the each fluid flow via of the fluid flow vias 520 with a technique such as $SF_6$ plasma etching and $XeF_2$ gas etching, up to the fluid flow channels 510. The isotropic etching of the substrate 500 from the top portion 502 results in the formation of the channels 560. Each channel of the channels 560 is configured between a corresponding fluid flow via of the fluid flow vias 520 and a corresponding via bridge of the via bridges 570, and is formed above the via bridges 570 due to high spatial density of the fluid flow vias 520. Accordingly, as depicted in FIG. 19, the via bridges 570 do not block the fluid flow vias 520 as the isotropic etching of the silicon material from the fluid flow vias 520 forms continuous channels (the channels 560) under the fluid flow vias 520 as well as above the via bridges 570.

At 718, a flow feature layer (not shown) may be configured over the substrate 500. At 720, a plurality of flow feature channels (not shown) may be configured within the flow feature layer such that at least one flow feature channel of the plurality of flow feature channels is in fluid communication with a corresponding fluid flow via of the fluid flow vias 520. At 722, a nozzle plate (not shown) may be configured over the flow feature layer. At 724, a plurality of nozzles (not shown) may be configured within the nozzle plate such that at least one nozzle of the plurality of nozzles is in fluid communication with a corresponding flow feature channel of the plurality of flow feature channels. The method 700 ends at 726.

Accordingly, in addition to the design of the fluid flow vias 520, mechanical strength of the fluid ejection device 50 is further improved with the via bridges 570. The design of the via bridge 570 is feasible for the fluid ejection device 50 with the fluid flow vias 520 because isotropic etching from the fluid flow vias 520 assists in forming the channels 560 between the fluid flow vias 520 and the via bridges 570, and accordingly, all the fluid flow vias 520 have access to fluids (inks). High spatial density of the fluid flow vias 520 (such as 28.22 μm spacing for 1800 dots per inch resolution and the configuration with one fluid flow via feeding one nozzle) guarantees the formation of continuous channels 560 under each row of the fluid flow vias 520, as well as above each via bridge of the via bridges 570.

Based on the foregoing, the present disclosure provides efficient and effective fluid ejection devices, such as the fluid ejection devices 20, 30, 40 and 50, with novel configurations of flow feature layers and photo-imaged nozzle plates over respective fluid flow vias that replace previously used large fluid through vias for feeding fluid to each firing chamber. Further, the present disclosure provides an effective and efficient method, such as the methods 600 and 700, for fabricating fluid flow vias with finely controlled depth within about 1 μm, by utilizing balloon-like isotropically etched cavities to connect bottom fluid flow channels having rough depth control at a fast etching rate to the finely depth-controlled fluid flow vias at a slow etching rate tolerable for the shallow etching.

Accordingly, the present disclosure provides employment of a nozzle plate well supported by a flow feature layer, wherein substrate/wafer planarity prior to nozzle plate lamination is significantly improved. Further, nozzle plate planarity is improved without any sagging leading to fluid ejection misdirection, i.e., low printing quality. Furthermore, contact area between the flow feature layer and the nozzle plate is significantly enlarged particularly near the flow feature channels (ink channels) including the filtering pillars. The larger contact area and more flattened flow feature layer surface provides a larger process window for lamination processes and significantly enhances the flow feature layer/nozzle plate adhesion. Also, for high resolution printheads, smaller contact area between the flow feature layer and the nozzle plate due to narrower (5 μm to 10 μm) side walls, has less impact on the flow feature layer/nozzle plate adhesion as per the designs of the present disclosure. Moreover, the design of the present disclosure that involves more support from the flow feature layer enables fabrication and use of nozzle plates that are expected to be thinner (3 μm to 10 μm).

Additionally, the designs of the present disclosure provide significantly decreased nozzle plate/fluid interaction (contact) area that aids in minimizing fluid ingression effect on printheads, printing quality and life time. When compared with current printheads, the designs of the present disclosure reduce nozzle plate/fluid interaction area by about 90 percent. Further, with smaller opportunity of nozzle plate/fluid interaction, further improvement in either photoimaged nozzle plate material's chemical resistance or fluid friendliness, may not be required.

In addition, the designs of the present disclosure assist in improving fluid ejection device (heater chip) integrity to enhance heater chip's strength and rigidity compared to current long through via chips. The connected fluid channels have more silicon strength for maintaining the heater chip's flatness after being mounted on the printhead assembly substrate. Further, a rigid back-substrate such as a ceramic plate may not be required to support the heater chip for maintaining flatness, thereby reducing the cost associated with the packaging of the heater chip. Also, the designs of the present disclosure enable good adhesion of the flow feature layer to the silicon substrate that enforces the silicon above the long fluid flow channels (slots) at the bottom surface of the heater chip in order to support the flow feature layer for more robust fluidic structures.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

The invention claimed is:

1. A fluid ejection device for an inkjet printer, the fluid ejection device comprising:

a substrate comprising, at least one fluid flow channel configured within a bottom portion of the substrate, each fluid flow channel of the at least one fluid flow channel being configured within the bottom portion by etching the bottom portion at a first predetermined etching rate, and a plurality of fluid flow vias configured within a top portion of the substrate, each fluid flow via of the plurality of fluid flow vias being configured within the top portion by etching the top portion at a second predetermined etching rate so that each fluid flow via of the plurality of fluid flow vias has a finely controlled depth so that the planarity of the substrate is maintained, the each fluid flow via of the plurality of fluid flow vias further being configured to be in fluid communication with a corresponding fluid flow channel of the at least one fluid flow channel through an isotropically etched cavity configured below the each fluid flow via and fluidically coupled to the corresponding fluid flow channel;

a flow feature layer configured over the substrate, the flow feature layer comprising a plurality of flow feature channels, wherein at least one flow feature channel of the plurality of flow feature channels is in fluid communication with a corresponding fluid flow via of the plurality of fluid flow vias; and a nozzle plate configured over the flow feature layer, the nozzle plate comprising a plurality of nozzles, wherein at least one nozzle of the plurality of nozzles is in fluid communication with a corresponding flow feature channel of the plurality of flow feature channels.

2. The fluid ejection device of claim 1, wherein the plurality of fluid flow vias is configured over the each fluid flow channel of the at least one fluid flow channel.

3. The fluid ejection device of claim 2, wherein the plurality of fluid flow vias is configured in at least one row arranged over the each fluid flow channel.

4. The fluid ejection device of claim 1, wherein the first etching rate is faster than the second etching rate.

5. The fluid ejection device of claim 1, wherein the bottom portion is etched by deep reactive ion etching technique.

6. The fluid ejection device of claim 1, wherein the top portion is etched by deep reactive ion etching technique.

7. The fluid ejection device of claim 1, wherein the substrate further comprises at least one via bridge, each via bridge of the at least one via bridge being configured within the bottom portion of the substrate and between two adjacent fluid flow channels of the at least one fluid flow channel.

8. The fluid ejection device of claim 1, wherein the each fluid flow via has a depth ranging from about 10 microns to about 100 microns.

* * * * *